US009214293B2

(12) United States Patent
Chen

(10) Patent No.: US 9,214,293 B2
(45) Date of Patent: Dec. 15, 2015

(54) KEY STRUCTURE WITH SCISSORS-TYPE CONNECTING MEMBER

(71) Applicant: Primax Electronics Ltd., Neihu, Taipei (TW)

(72) Inventor: Bo-An Chen, Taipei (TW)

(73) Assignee: PRIMAX ELECTRONICS LTD., Neihu (TW)

( * ) Notice: Subject to any disclaimer, the term of this patent is extended or adjusted under 35 U.S.C. 154(b) by 30 days.

(21) Appl. No.: 14/076,470

(22) Filed: Nov. 11, 2013

(65) Prior Publication Data

US 2015/0090568 A1 Apr. 2, 2015

(30) Foreign Application Priority Data

Sep. 27, 2013 (TW) ..... 102135117 A

(51) Int. Cl.
*H01H 13/70* (2006.01)
*H01H 3/12* (2006.01)

(52) U.S. Cl.
CPC ..... *H01H 3/125* (2013.01)

(58) Field of Classification Search
CPC ..... H01H 13/70; H01H 3/00; H01H 3/04; H01H 3/02; H01H 3/12; H01H 2003/00; H01H 2003/12; H01H 2219/036; H01H 2233/07; H01H 2237/004; H01H 2239/056
See application file for complete search history.

(56) References Cited

U.S. PATENT DOCUMENTS 5,278,372 A * 1/1994 Takagi et al. ..... 200/344
7,385,149 B2 * 6/2008 Liu ..... 200/5 A

* cited by examiner

*Primary Examiner* — Edwin A. Leon
*Assistant Examiner* — Anthony R. Jimenez
(74) *Attorney, Agent, or Firm* — Kirton McConkie; Evan R. Witt

(57) ABSTRACT

A key structure includes a base plate, a keycap, a scissors-type connecting member, and an elastic element. The scissors-type connecting member is connected with the base plate and the keycap. After the key structure is assembled and the keycap is not assembled, the elastic element provides an upward first elastic force, and the scissors-type connecting member is bent to provide a downward second elastic force. By exerting a small force on the keycap, the key structure can be triggered.

10 Claims, 5 Drawing Sheets

KEY STRUCTURE WITH SCISSORS-TYPE CONNECTING MEMBER

FIELD OF THE INVENTION

The present invention relates to a key structure, and more particularly to a key structure for a keyboard device.

BACKGROUND OF THE INVENTION

Nowadays, computers are widely used and become essential parts in our daily lives. In addition to the working purposes, computers may be employed as amusement tools. With increasing development of computers, computer peripheral devices make great progress. Moreover, input devices play important roles in communicating computers and user. As known, a keyboard device is one of the most important input devices. Consequently, the manufacturers of keyboard device make efforts in designing novel keyboard devices with special functions in order to meet the requirements of different users.

Generally, a keyboard device comprises plural key structures. Hereinafter, a conventional key structure will be illustrated with reference to FIGS. 1 and 2. FIG. 1 is a schematic exploded view illustrating a conventional key structure. FIG. 2 is a schematic side view illustrating the conventional key structure of FIG. 1, in which the keycap is not depressed. As shown in FIGS. 1 and 2, the conventional key structure 1 comprises a keycap 11, a scissors-type connecting member 12, a rubbery elastic element 13, a membrane switch circuit board 14, and a base plate 15. The keycap 11 may be depressed by a user. In addition, the keycap 11 is connected with the scissors-type connecting member 12. The keycap 11 comprises a first fixing structure 111 and a second fixing structure 112. The first fixing structure 111 is disposed on a bottom surface 113 of the keycap 11, and located at a first side of the keycap 11. The second fixing structure 112 is disposed on the bottom surface 113 of the keycap 11, and located at a second side of the keycap 11. The base plate 15 comprises a third fixing structure 151 and a fourth fixing structure 152. The third fixing structure 151 is disposed on the base plate 15, and located at a first side of the base plate 15. The fourth fixing structure 152 is disposed on the base plate 15, and located at a second side of the base plate 15. The first fixing structure 111 and the third fixing structure 151 are close-type hooks, and the second fixing structure 112 and the fourth fixing structure 152 are open-type hooks.

The scissors-type connecting member 12 comprises an inner frame 121 and an outer frame 122. A first end of the inner frame 121 is connected with the first fixing structure 111 of the keycap 11. A second end of the inner frame 121 is connected with the fourth fixing structure 152 of the base plate 15. A first end of the outer frame 122 is connected with the third fixing structure 151 of the base plate 15. A second end of the outer frame 122 is connected with the second fixing structure 112 of the keycap 11. Consequently, the scissors-type connecting member 12 is connected with the keycap 11 and the base plate 15. The inner frame 121 has an inner frame shaft 1211. The outer frame 122 has an outer frame hole 1221 corresponding to the inner frame shaft 1211. After the inner frame shaft 1211 is inserted into the outer frame hole 1221, the inner frame 121 and the outer frame 122 are combined together. Consequently, the inner frame 121 is rotatable relative to the outer frame 122. The membrane switch circuit board 14 is disposed on the base plate 15. The rubbery elastic element 13 is arranged between the keycap 11 and the membrane switch circuit board 14. When the keycap 11 is depressed, the rubbery elastic element 13 is pushed by the keycap 11 and thus subject to deformation. Consequently, the membrane switch circuit board 14 is triggered to generate a key signal. After the above components are combined together, the assembled configuration of the key structure 1 is shown in FIG. 2.

Hereinafter, the operations of the conventional key structure 1 will be illustrated with reference to FIGS. 2 and 3. FIG. 3 is a schematic side view illustrating the conventional key structure of FIG. 1, in which the keycap is depressed. In case that the key structure 1 is not depressed (see FIG. 2), the keycap 11 of the key structure 1 is located at a first height H1. Meanwhile, the inner frame 121 and the outer frame 122 intersect each other, so that the scissors-type connecting member 12 is in an open-scissors state. In addition, the second end of the outer frame 122 is located at a first position P1 of the second fixing structure 112. Whereas, when the key structure 1 is depressed, a downward pressing force is exerted on the keycap 11, and the rubbery elastic element 13 is compressed in response to the pressing force. Moreover, as the keycap 11 is depressed, the inner frame 121 and the outer frame 122 of the scissors-type connecting member 12 are correspondingly rotated by using the inner frame shaft 1211 and the outer frame hole 1221 as the rotating shaft. Meanwhile, the inner frame 121 and the outer frame 122 are is in a folded state. At the same time, the membrane switch circuit board 14 on the base plate 15 is pressed and triggered to generate a corresponding key signal. Moreover, as shown in FIG. 3, the keycap 11 of the key structure 1 is located at a second height H2, and the second end of the outer frame 122 is moved to a second position P2 of the second fixing structure 112. Generally, the difference between the first height H1 and the second height H2 indicates a travelling distance of the key structure 1.

In case that the keycap 11 is no longer depressed, the keycap 11 will be moved upwardly is response to a restoring force of the compressed rubbery elastic element 13. As the keycap 11 is moved upwardly, the inner frame 121 and the outer frame 122 are towed by the keycap 11 and correspondingly rotated. Consequently, the keycap 11 is moved to the first height H1, and the second end of the outer frame 122 is returned to the first position P1 of the second fixing structure 112.

However, the conventional key structure 1 still has some drawbacks. For example, as the computer has been used for a long time, the user is readily suffered from finger fatigue or even finger injury because of frequently depressing the key structure 1.

Therefore, there is a need of providing a labor-saving key structure in order to solve the above drawbacks.

SUMMARY OF THE INVENTION

The present invention provides a labor-saving key structure with a scissors-type connecting member.

In accordance with an aspect of the present invention, there is provided a key structure. The key structure includes a base plate, a keycap, a scissors-type connecting member, and an elastic element. The keycap is disposed over the base. When the keycap is depressed, the keycap is moved relative to the base plate. The scissors-type connecting member is arranged between the base plate and the keycap for connecting the base plate with the keycap, thereby allowing the keycap to be moved upwardly or upwardly respective to the base plate. The elastic element is arranged between the base plate and the keycap and penetrated through the scissors-type connecting member. The elastic element is contacted with the keycap and provides an elastic force to the keycap. When the keycap is not depressed, the scissors-type connecting member is bent.

In accordance with another aspect of the present invention, there is provided a key structure. The key structure includes a base plate, a keycap, a scissors-type connecting member, and an elastic element. The keycap is disposed over the base. When the keycap is depressed, the keycap is moved relative to the base plate. The scissors-type connecting member is arranged between the base plate and the keycap for connecting the base plate with the keycap, thereby allowing the keycap to be moved upwardly or upwardly respective to the base plate. The scissors-type connecting member includes a first frame and a second frame. The first frame includes a first sidewall. A first end of the first sidewall is connected with the keycap, and a second end of the first sidewall is connected with the base plate. The second frame is pivotally coupled to the first frame. The second frame is rotatable relative to the first frame by using a pivotal point between the first frame and the second frame as a rotating shaft. The second frame comprises a second sidewall, a first end of the second sidewall is connected with the base plate, and a second end of the second sidewall is connected with the keycap. The elastic element is arranged between the base plate and the keycap and penetrated through the scissors-type connecting member. The elastic element is contacted with the keycap and provides an elastic force to the keycap. The first end of the first sidewall is thinner than the second end of the first sidewall, and the first end of the second sidewall is thicker than the second end of the first sidewall.

The present invention provides a key structure with a scissors-type connecting member. In the scissors-type connecting member, the first segment and the fourth segment are thinner, and the second segment and the third segment are thicker. Consequently, the scissors-type connecting member is bent to provide a downward second elastic force. Since the scissors-type connecting member of the key structure can provide the downward second elastic force, the user may exert a small pushing force on the keycap. Once the downward force (e.g. the second elastic force and the pushing force) is larger than the upward force (i.e. the first elastic force), the keycap is moved downwardly, and thus the switch circuit board is triggered by the elastic element. Since the key structure of the present invention is operated in response to a small force, the key structure of the present invention is labor-saving.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For eliminating the drawbacks of the conventional technology, the present invention provides a key structure for a keyboard device. The keyboard device comprises plural key structures. In the following embodiments, only a single key structure will be illustrated.

Figure 1:
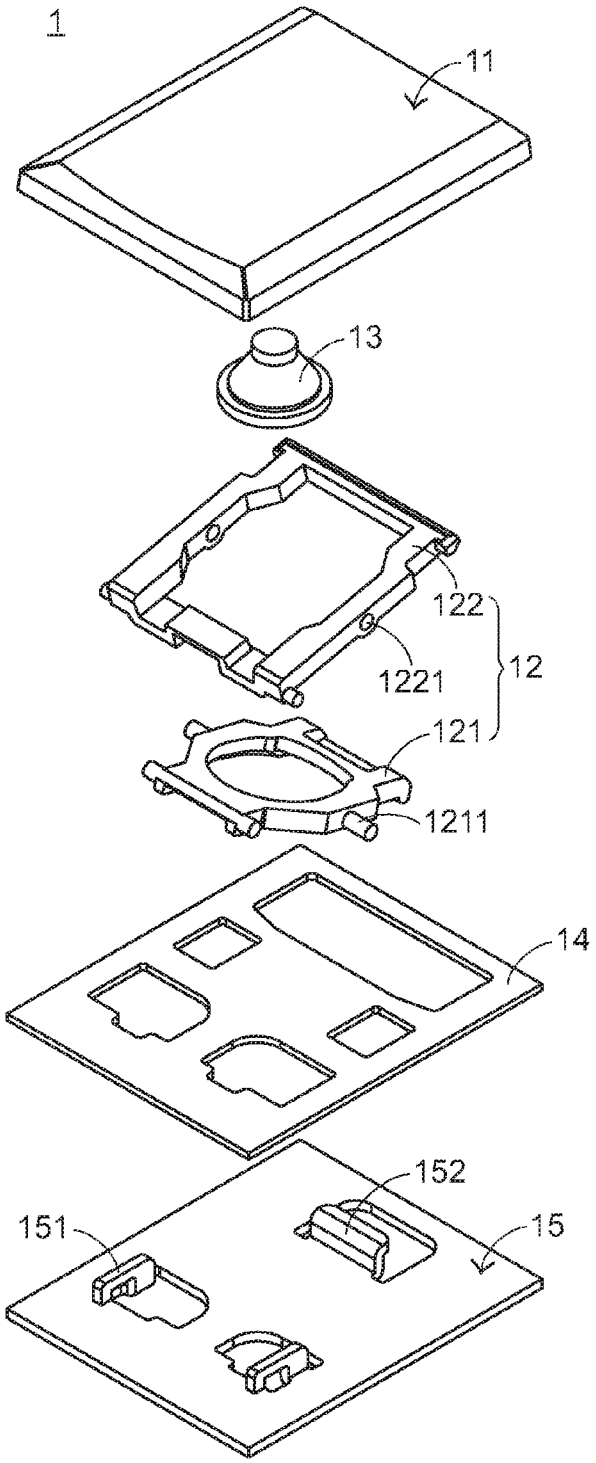
FIG.1 PRIOR ART
FIG. 1 is a schematic exploded view illustrating a conventional key structure.
Figure 2:
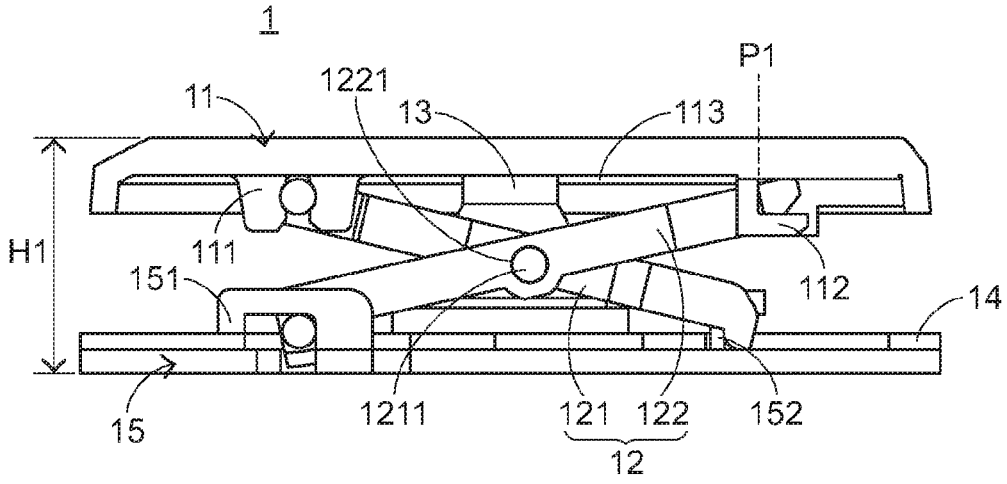
FIG.2 PRIOR ART
FIG. 2 is a schematic side view illustrating the conventional key structure of FIG. 1, in which the keycap is not depressed.
Figure 3:
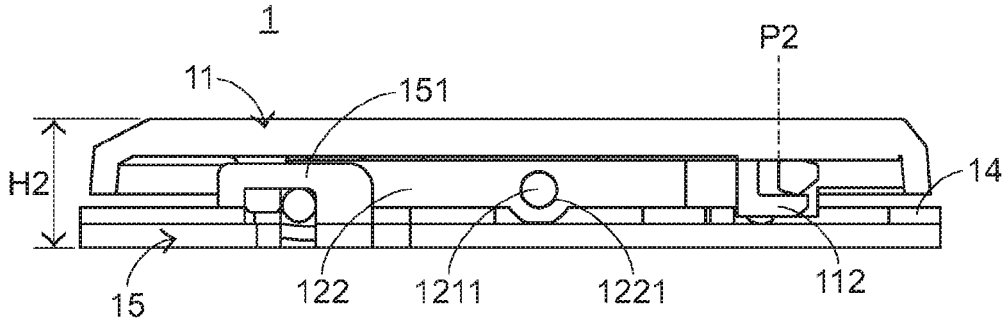
FIG.3 PRIOR ART
FIG. 3 is a schematic side view illustrating the conventional key structure of FIG. 1, in which the keycap is depressed.
Figure 4:
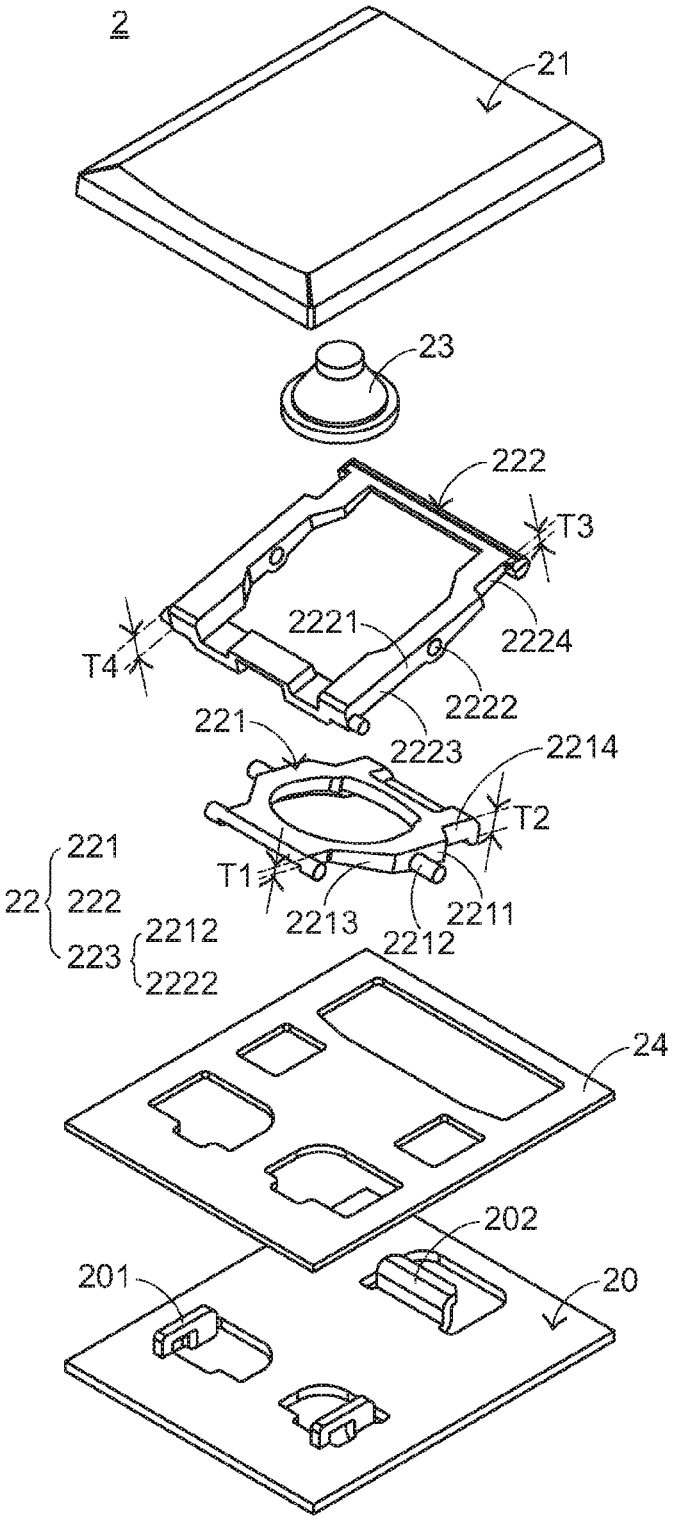
FIG. 4 is a schematic exploded view illustrating a key structure with a scissors-type connecting member according to a first embodiment of the present invention.
Figure 5:
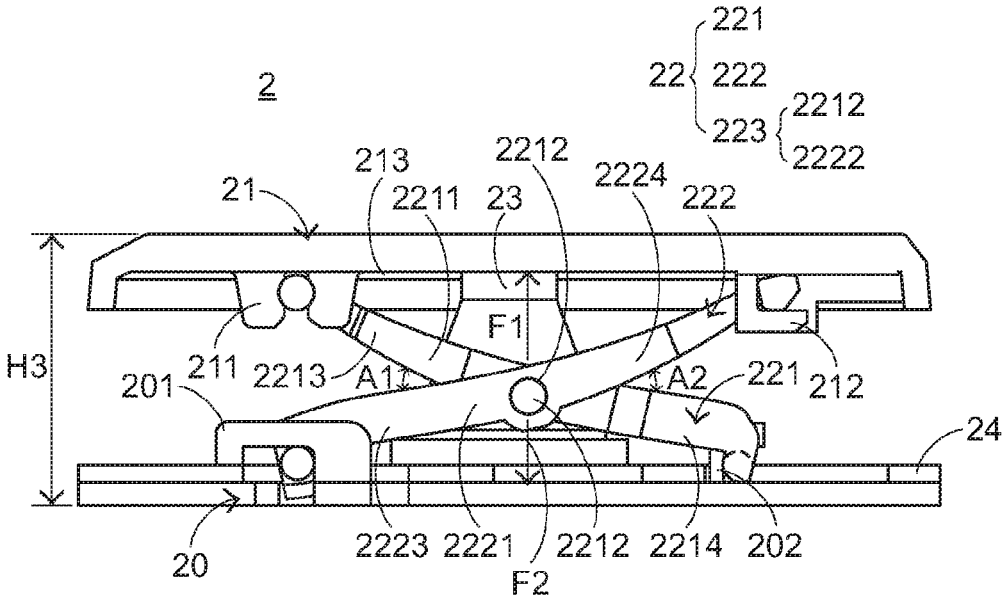
FIG. 5 is a schematic side view illustrating the key structure of FIG. 4, in which the keycap is not depressed.

Hereinafter, a conventional key structure will be illustrated with reference to FIGS. 4 and 5. FIG. 4 is a schematic exploded view illustrating a key structure with a scissors-type connecting member according to a first embodiment of the present invention. FIG. 5 is a schematic side view illustrating the key structure of FIG. 4, in which the keycap is not depressed. As shown in FIGS. 4 and 5, the key structure 2 comprises a base plate 20, a keycap 21, a scissors-type connecting member 22, an elastic element 23, and a switch circuit board 24. The base plate 20 is connected with the scissors-type connecting member 22. The base plate 20 comprises a third fixing structure 201 and a fourth fixing structure 202. The third fixing structure 201 is disposed on the base plate 20, and located at a first side (e.g. the left side as shown in FIG. 5) of the base plate 20. The fourth fixing structure 202 is disposed on the base plate 20, and located at a second side (e.g. the right side as shown in FIG. 5) of the base plate 20. The keycap 21 is disposed over the base plate 20. When the keycap 21 is depressed, the keycap 21 is moved relative to the base plate 20. The keycap 21 comprises a first fixing structure 211 and a second fixing structure 212. The first fixing structure 211 is disposed on a bottom surface 213 of the keycap 21, and located at a first side (e.g. the left side as shown in FIG. 5) of the keycap 21. The second fixing structure 212 is disposed on the bottom surface 213 of the keycap 21, and located at a second side (e.g. the right side as shown in FIG. 5) of the keycap 21.

In this embodiment, the first fixing structure 211 and the second fixing structure 212 are integrally formed with the keycap 21, and the third fixing structure 201 and the fourth fixing structure 202 are integrally formed with the base plate 20. In addition, both of the first fixing structure 211 and the third fixing structure 201 are close-type hooks, and both of the second fixing structure 212 and the fourth fixing structure 202 are open-type hooks, but are not limited thereto. Alternatively, in some other embodiments, each of the first fixing structure, the second fixing structure, the third fixing structure and the fourth fixing structure is an open-type hook or a close-type hook.

The scissors-type connecting member 22 is arranged between the base plate 20 and the keycap 21 for connecting the base plate 20 with the keycap 21, thereby allowing the keycap 21 to be moved upwardly or upwardly with respect to the base plate 20. In this embodiment, the scissors-type connecting member 22 comprises a first frame 221 and a second frame 222. The second frame 222 is pivotally coupled to the first frame 221. There is a pivotal point 223 between the second frame 222 and the first frame 221. The second frame 222 is rotatable relative to the first frame 221 by using the pivotal point 223 as a rotating shaft. The first frame 221 comprises a first sidewall 2211 and a connecting shaft 2212. A first end of the first sidewall 2211 is connected with the first fixing structure 211 of the keycap 21. A second end of the first sidewall 2211 is connected with the fourth fixing structure 202 of the base plate 20. The connecting shaft 2212 is located at a middle region of the first sidewall 2211, and externally extended from the first sidewall 2211. Moreover, the second frame 222 comprises a second sidewall 2221 and a connecting hole 2222. A first end of the second sidewall 2221 is connected with the third fixing structure 201 of the base plate 20. A second end of the second sidewall 2221 is connected with the second fixing structure 212 of the keycap 21. The connecting hole 2222 is formed in a middle region of the second sidewall 2221. After the connecting shaft 2212 is inserted into the connecting hole 2222, the first frame 221 and the second frame 222 are connected with each other and rotatable relative to each other. When the first frame 221 and the second frame 222 are rotated relative to each other, the connecting shaft 2212 is rotated within the connecting hole 2222. In this embodiment, the pivotal point 223 is defined by the connecting shaft 2212 and the connecting hole 2222 collaboratively. In this embodiment, both of the first frame 221 and the second frame 222 are made of polyoxymethylene (POM) or polypropylene (PP).

In the first frame 221, the first sidewall 2211 comprises a first segment 2213 and a second segment 2214. The first segment 2213 is the segment from the first end of the first sidewall 2211 to the middle region of the first sidewall 2211, and the first segment 2213 has a first thickness T1. The second segment 2214 is the segment from the second end of the first sidewall 2211 to the middle region of the first sidewall 2211, and the second segment 2214 has a second thickness T2. Especially, the first thickness T1 is smaller than the second thickness T2. In the second frame 222, the second sidewall 2221 comprises a third segment 2223 and a fourth segment 2224. The third segment 2223 is the segment from the first end of the second sidewall 2221 to the middle region of the second sidewall 2221, and the third segment 2223 has a fourth thickness T4. The fourth segment 2224 is the segment from the second end of the second sidewall 2221 to the middle region of the second sidewall 2221, and the fourth segment 2224 has a third thickness T3. Especially, the third thickness T3 is smaller than the fourth thickness T4. In other words, the segment of the scissors-type connecting member 22 closer to the keycap 21 is thinner than the segment of the scissors-type connecting member 22 closer to the base plate 20.

The elastic element 23 is arranged between the base plate 20 and the keycap 21, and penetrated through the scissors-type connecting member 22. The elastic element 23 is contacted with the keycap 21, and provides an elastic force to the keycap 21. The switch circuit board 24 is disposed on the base plate 20, and disposed under the elastic element 23. When the switch circuit board 24 is triggered by the elastic element 23, a key signal is correspondingly generated by the switch circuit board 24. In this embodiment, the elastic element 23 is a rubber elastic element, and the switch circuit board 24 is a membrane switch circuit board comprising an upper wiring board, a partition plate and a lower wiring board.

Figure 6:
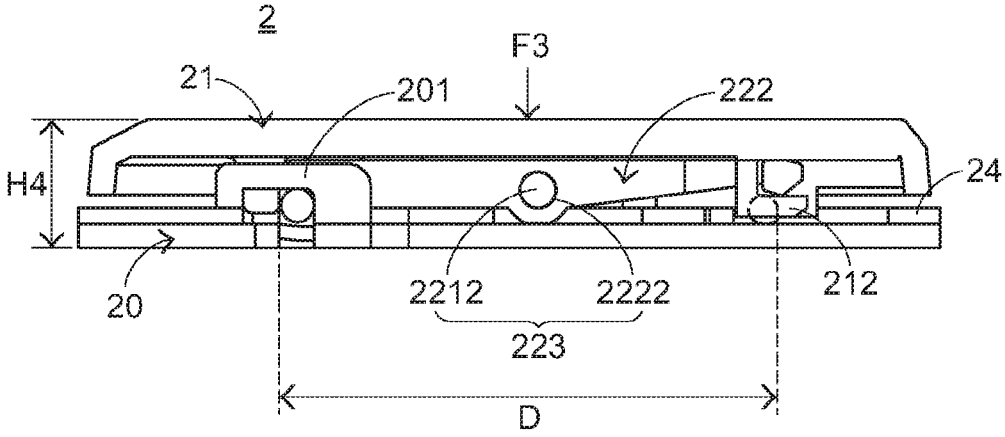
FIG. 6 is a schematic side view illustrating the key structure of FIG. 4, in which the keycap is depressed.

After the base plate 20, the keycap 21, the scissors-type connecting member 22, the elastic element 23 and the switch circuit board 24 are combined together, the resulting configuration of the key structure 2 is shown in FIG. 5. In case that the keycap 21 is not depressed, the scissors-type connecting member 22 is bent, and the keycap 21 is located at a first height H3. Since the scissors-type connecting member 22 is bent, the overall length of the bent second segment 2214 and the bent third segment 2223 is equal to a distance D between the second end of the first sidewall 2211 of the first frame 221 in a folded state and the first end of the second sidewall 2221 of the second frame 222 in the folded state (see FIG. 6). The reason why the scissors-type connecting member 22 is bent is that the first thickness T1 and the third thickness T3 of the segments of the scissors-type connecting member 22 closer to the keycap 21 are smaller than the second thickness T2 and the fourth thickness T4 closer to the base plate 20, respectively. Moreover, since the thickness of the scissors-type connecting member 22 is not uniform, after the scissors-type connecting member 22 and the base plate 20 and the keycap 21 are combined together, a second elastic force F2 in the direction toward the base plate 20 (i.e. the downward direction as shown in FIG. 5) is generated by the scissors-type connecting member 22. Moreover, since the key structure 2 is not depressed, a first elastic force F1 in a direction toward the keycap 21 (i.e. the upward direction as shown in FIG. 5) is generated by the elastic element 23. The second elastic force F2 of the scissors-type connecting member 22 is smaller than the first elastic force F1. Consequently, the keycap 21 is located at the first height H3.

From the above discussions, when the key structure 2 is not depressed, the second elastic force F2 in the direction toward the base plate 20 is generated by the scissors-type connecting member 22. Consequently, while the keycap 21 is depressed by the user, the user only has to exert a small pushing force F3 on the keycap 21. Once the sum of the pushing force F3 and the second elastic force F2 is larger than the first elastic force F1 provided by the elastic element 23, the keycap 21 is moved relative to the base plate 20 to a second height H4. Moreover, as the keycap 21 is moved downwardly, the elastic element 23 is compressed, and the switch circuit board 24 is triggered by the elastic element 23 to generate a key signal (see FIG. 6). When the keycap 21 is no longer depressed by the user, the pushing force F3 exerted on the keycap 21 is eliminated. Consequently, the upward first elastic force F1 is larger than the downward second elastic force F2, and the keycap 21 is pushed by the elastic element 23 to be moved to the first height H3 (see FIG. 5). In other words, since the switch circuit board 24 is triggered to generate the key signal in response to the small pushing force F3 on the keycap 21, the use of the key structure 2 is labor-saving.

In addition, two special aspects should be further described. Firstly, during the process of depressing and moving the keycap 21, the movement of the keycap 21 and the deformation of the scissors-type connecting member 22 simultaneously occur. At the same time, the second end of the first sidewall 2211 is not moved relative to the fourth fixing structure 202, but the second end of the second sidewall 2221 is slightly moved toward the open side of the second fixing structure 212 (i.e. the right side as shown in FIG. 5). However, the moving distance of the second end of the second sidewall 2221 is shorter than the distance between the first position P1 and the second position P2 of the conventional key structure 1. The reason why the scissors-type connecting member 22 is subject to deformation is that the thickness of the scissors-type connecting member 22 is not uniform. Due to the non-uniform thickness, the scissors-type connecting member 22 has the flexibility to be bent, and the scissors-type connecting member 22 is deformable. Moreover, since the scissors-type connecting member 22 is made of a more rigid material, the scissors-type connecting member 22 has both of the flexibility and the rigidity. In other words, the possibility of causing damage of the scissors-type connecting member 22 is minimized.

Secondly, although the scissors-type connecting member 22 is bent, a first included angle A1 between the first segment 2213 and the third segment 2223 is equal to a second included angle A2 between the second segment 2214 and the fourth segment 2224. Consequently, the scissors-type connecting member 22 can be maintained in the equilibrium state without being rocked. In other words, the scissors-type connecting member 22 can provide a smooth and stable tactile feel to the user. Moreover, since the scissors-type connecting member 22 is bent, a third included angle (not shown) between the first segment 2213 and the fourth segment 2224 is smaller than a fourth included angle (not shown) between the second segment 2214 and the third segment 2223. In the scissors-type connecting member of the conventional key structure, the two included angles corresponding to the third included angle and the fourth included angle are identical. In other words, the scissors-type connecting member 22 of the key structure 2 of the present invention is distinguished from the scissors-type connecting member of the conventional key structure.

Figure 7:
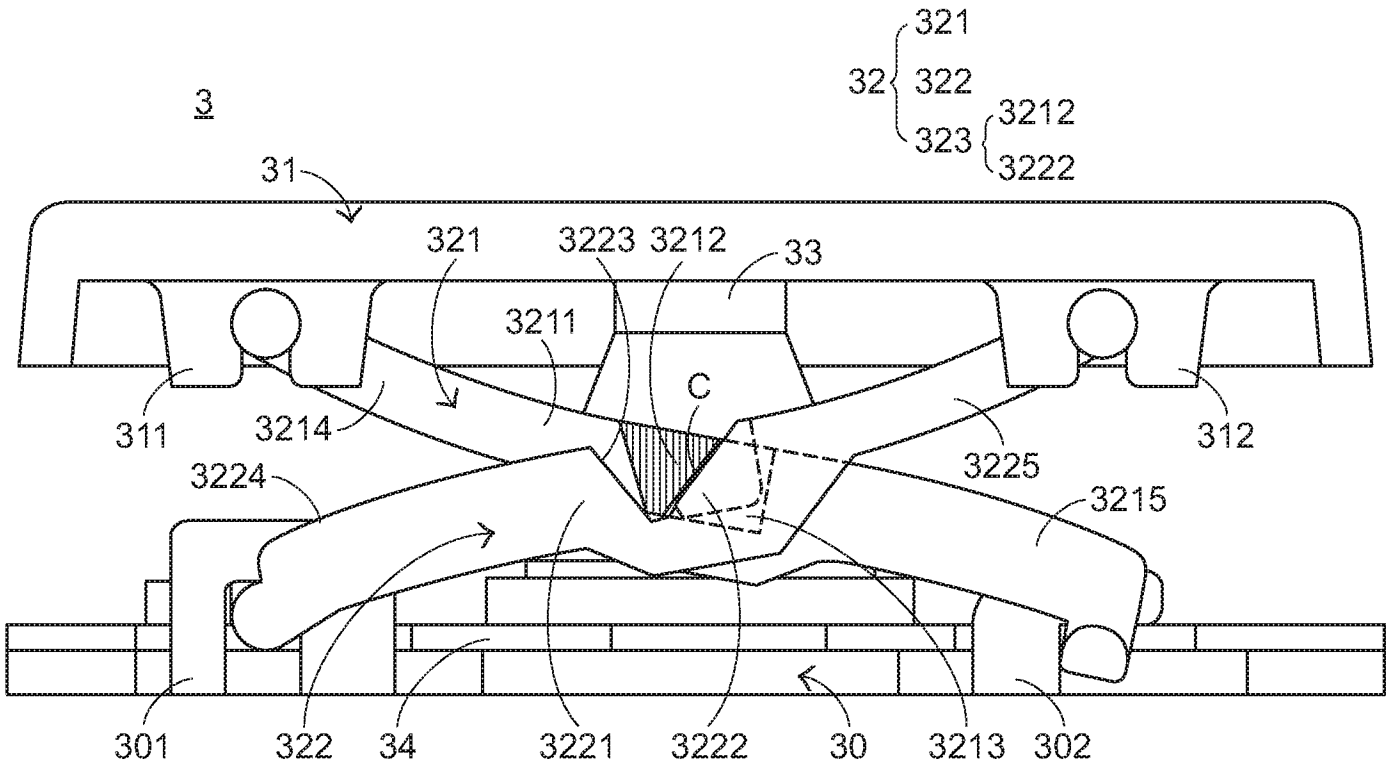
FIG. 7 is a schematic side view illustrating a key structure according to a second embodiment of the present invention.

The present invention further provides a second embodiment of a key structure. FIG. 7 is a schematic side view illustrating a key structure according to a second embodiment of the present invention. As shown in FIG. 7, the key structure 3 comprises a base plate 30, a keycap 31, a scissors-type connecting member 32, an elastic element 33, and a switch circuit board 34. The base plate 30 comprises a third fixing structure 301 and a fourth fixing structure 302. The keycap 31 comprises a first fixing structure 311 and a second fixing structure 312. The scissors-type connecting member 32 comprises a first frame 321, a second frame 322, and a pivotal point 323. Except for the following items, the other components of the key structure 3 of this embodiment is substantially identical to those of the key structure 2 of the first embodiment, and are not redundantly described herein. Firstly, the structures of the first frame 321 and the second frame 322 are distinguished. Secondly, the structures of the first fixing structure 311, the second fixing structure 312, the third fixing structure 301 and the fourth fixing structure 302 are distinguished.

In accordance with the first distinguished item, the first frame 321 comprises a first sidewall 3211, a first convex part 3212, and a first receiving recess 3213. The first convex part 3212 is disposed on the first sidewall 3211, and externally extended from the first sidewall 3211. The second frame 322 comprises a second sidewall 3221, a second convex part 3222, and a second receiving recess 3223. The second convex part 3222 is disposed on the second sidewall 3221, and externally extended from the second sidewall 3221. The first receiving recess 3213 is formed in the first sidewall 3211 for receiving the second convex part 3222. The second receiving recess 3223 is formed in the second sidewall 3221 for receiving the first convex part 3212. After the first convex part 3212 is inserted into the second receiving recess 3223 and the second convex part 3222 is inserted into the first receiving recess 3213, the first frame 321 and the second frame 322 are connected with each other and rotatable relative to each other. Consequently, the first convex part 3212 is moved within the second receiving recess 3223, and the second convex part 3222 is moved within the first receiving recess 3213. In other words, the pivotal point 323 is defined by the first convex part 3212 and the second convex part 3222 collaboratively.

In the scissors-type connecting member 32, a first segment 3214 of the first sidewall 3211 is the segment from a first end of the first sidewall 3211 to a junction C between the first convex part 3212 and the second convex part 3222. Moreover, a second segment 3215 of the first sidewall 3211 is the segment from a second end of the first sidewall 3211 to the junction C between the first convex part 3212 and the second convex part 3222. A third segment 3224 of the second sidewall 3221 is the segment from a first end of the second sidewall 3221 to the junction C between the first convex part 3212 and the second convex part 3222. A fourth segment 3225 of the second sidewall 3221 is the segment from a second end of the second sidewall 3221 to the junction C between the first convex part 3212 and the second convex part 3222. The first segment 3214 has a first thickness T1. The second segment 3215 has a second thickness T2. The third segment 3224 has a fourth thickness T4. The fourth segment 3225 has a third thickness T3. The first thickness T1 is smaller than the second thickness T2, and the third thickness T3 is smaller than the fourth thickness T4.

In accordance with the second distinguished item, the first fixing structure 311, the second fixing structure 312 and the third fixing structure 301 are close-type hooks, and the fourth fixing structure 302 is an open-type hook. Consequently, the scissors-type connecting member 32, the keycap 31 and the base plate 30 can be assembled more easily. Moreover, since the fourth fixing structure 302 is the open-type hook, while the keycap 31 is depressed, the second end of the first sidewall 3211 is slightly moved toward the open side of the fourth fixing structure 302 (i.e. the right side as shown in FIG. 7). However, since the moving distance of the second end of the first sidewall 3211 is very small, it may be considered that the second end of the first sidewall 3211 is immobile. In comparison with the key structure 2 having two open-type hooks (i.e. the first embodiment), the travelling distance of the keycap 31 for the key structure 3 having only one open-type hook (i.e. the fourth fixing structure 302) is slightly reduced. In other words, open-type hooks, close-type hooks or the combination thereof may be used as the fixing structures of the key structure of the present invention according to the practical requirements. Consequently, the travelling distance of the keycap is adjustable to provide a desired tactile feel according to the practical requirements.

From the above descriptions, the present invention provides a key structure with a scissors-type connecting member. In the scissors-type connecting member, the first segment and the fourth segment are thinner, and the second segment and the third segment are thicker. Consequently, the scissors-type connecting member is bent to provide a downward second elastic force. Since the scissors-type connecting member of the conventional key structure fails to provide the downward force, the force of depressing the conventional key structure should be larger than the elastic force of the elastic element. In contrast, since the scissors-type connecting member of the key structure of the present invention can provide the downward second elastic force, the user may exert a small pushing force on the keycap. Once the downward force (e.g. the second elastic force and the pushing force) is larger than the upward force (i.e. the first elastic force), the keycap is moved downwardly, and thus the switch circuit board is triggered by the elastic element. Since the key structure of the present invention is operated in response to a small force, the key structure of the present invention is labor-saving.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A key structure with a scissors-type connecting member, the key structure comprising:

a base plate;

a keycap disposed over the base plate, wherein when the keycap is depressed, the keycap is moved relative to the base plate;

the scissors-type connecting member arranged between the base plate and the keycap for connecting the base plate with the keycap, thereby allowing the keycap to be moved upwardly or upwardly respective to the base plate, wherein the scissors-type connecting member comprises:

a first frame comprising a first sidewall, wherein a first end of the first sidewall is connected with the keycap, and a second end of the first sidewall is connected with the base plate, wherein a first segment of the first sidewall is thinner than a second segment of the first sidewall, wherein the first segment is closer to the first end of the first sidewall, and the second segment is closer to the second end of the first sidewall; and a second frame pivotally coupled to the first frame, wherein the second frame is rotatable relative to the first frame by using a pivotal point between the first frame and the second frame as a rotating shaft, wherein the second frame comprises a second sidewall, a first end of the second sidewall is connected with the base plate, and a second end of the second sidewall is connected with the keycap, wherein a third segment of the second sidewall is thicker than a fourth segment of the second sidewall, wherein the third segment is closer to the first end of the second sidewall, and the fourth segment is closer to the second end of the second sidewall, wherein the pivotal point is defined by a first convex part of the first frame and a second convex part of the second frame collaboratively, wherein the first frame further comprises a first receiving recess for receiving the second convex part, and the first convex part and the first receiving recess are both disposed on the first sidewall, wherein the second frame further comprises a second receiving recess for receiving the first convex part, and the second convex part and the second receiving recess are both disposed on the second sidewall, wherein after the first convex part is inserted into the second receiving recess and the second convex part is inserted into the first receiving recess, the first frame and the second frame are connected with each other and rotatable relative to each other, wherein when the first frame and the second frame are connected with each other, the first convex part is moved within the second receiving recess, and the second convex part is moved within the first receiving recess; and an elastic element arranged between the base plate and the keycap and penetrated through the scissors-type connecting member, wherein the elastic element is contacted with the keycap and provides an elastic force to the keycap, wherein a segment of the scissors-type connecting member closer to the keycap is thinner than a segment of the scissors-type connecting member closer to the base plate, so that when the keycap is not depressed, the scissors-type connecting member is bent.

2. The key structure according to claim 1, wherein the pivotal point is defined by a connecting shaft of the first frame and a connecting hole of the second frame collaboratively, wherein the connecting shaft is disposed on a middle region of the first sidewall and externally extended from the first sidewall, and the connecting hole is formed in a middle region of the second sidewall, wherein after the connecting shaft is inserted into the connecting hole, the first frame and the second frame are connected with each other and rotatable relative to each other, wherein when the first frame and the second frame are rotated relative to each other, the connecting shaft is rotated within the connecting hole.

3. The key structure according to claim 2, wherein when the scissors-type connecting member is fixed between the base plate and the keycap, an overall length of the second segment and the third segment is equal to a distance between the second end of the first sidewall and the first end of the second sidewall, wherein the first segment is a segment from the first end of the first sidewall of the first frame to the middle region of the first sidewall, the second segment is a segment from the second end of the first sidewall of the first frame to the middle region of the first sidewall, the third segment is a segment from the first end of the second sidewall of the second frame to the middle region of the second sidewall, and the fourth segment is a segment from the second end of the second sidewall of the second frame to the middle region of the second sidewall.

4. The key structure according to claim 1, wherein when the scissors-type connecting member is fixed between the base plate and the keycap, an overall length of the second segment and the third segment is equal to a distance between the second end of the first sidewall and the first end of the second sidewall, wherein the first segment is a segment from a first end of the first sidewall to a junction between the first convex part and the second convex part, the second segment is a segment from a second end of the first sidewall to the junction between the first convex part and the second convex part, the third segment is a segment from a first end of the second sidewall to the junction between the first convex part and the second convex part, and the fourth segment is the segment from a second end of the second sidewall to the junction between the first convex part and the second convex part.

5. The key structure according to claim 1, wherein the keycap further comprises a first fixing structure and a second fixing structure, and the base plate further comprises a third fixing structure and a fourth fixing structure, wherein the first fixing structure is disposed on a bottom surface of the keycap, located at a first side of the keycap, and connected with the first end of the first sidewall of the first frame, wherein the second fixing structure is disposed on the bottom surface of the keycap, located at a second side of the keycap, and connected with the second end of the second sidewall of the second frame, wherein the third fixing structure is disposed on the base plate, located at a first side of the base plate, and connected with the first end of the second sidewall of the second frame, wherein the fourth fixing structure is disposed on the base plate, located at a second side of the base plate, and connected with the second end of the first sidewall of the first frame.

6. A key structure with a scissors-type connecting member, the key structure comprising:

a base plate;

a keycap disposed over the base plate, wherein when the keycap is depressed, the keycap is moved relative to the base plate;

the scissors-type connecting member arranged between the base plate and the keycap for connecting the base plate with the keycap, thereby allowing the keycap to be moved upwardly or upwardly respective to the base plate, wherein the scissors-type connecting member comprises:

a first frame comprising a first sidewall, wherein a first end of the first sidewall is connected with the keycap, and a second end of the first sidewall is connected with the base plate; and a second frame pivotally coupled to the first frame, wherein the second frame is rotatable relative to the first frame by using a pivotal point between the first frame and the second frame as a rotating shaft, wherein the second frame comprises a second sidewall, a first end of the second sidewall is connected with the base plate, and a second end of the second sidewall is connected with the keycap; and an elastic element arranged between the base plate and the keycap and penetrated through the scissors-type connecting member, wherein the elastic element is contacted with the keycap and provides an elastic force to the keycap, wherein the first end of the first sidewall is thinner than the second end of the first sidewall, and the first end of the second sidewall is thicker than the second end of the first sidewall, so that when the keycap is not depressed, the scissors-type connecting member is bent, wherein the pivotal point is defined by a first convex part of the first frame and a second convex part of the second frame collaboratively, wherein the first frame further comprises a first receiving recess for receiving the second convex part, and the first convex part and the first receiving recess are both disposed on the first sidewall, wherein the second frame further comprises a second receiving recess for receiving the first convex part, and the second convex part and the second receiving recess are both disposed on the second sidewall, wherein after the first convex part is inserted into the second receiving recess and the second convex part is inserted into the first receiving recess, the first frame and the second frame are connected with each other and rotatable relative to each other, wherein when the first frame and the second frame are connected with each other, the first convex part is moved within the second receiving recess, and the second convex part is moved within the first receiving recess.

7. The key structure according to claim 6, wherein the pivotal point is defined by a connecting shaft of the first frame and a connecting hole of the second frame collaboratively, wherein the connecting shaft is disposed on a middle region of the first sidewall and externally extended from the first sidewall, and the connecting hole is formed in a middle region of the second sidewall, wherein after the connecting shaft is inserted into the connecting hole, the first frame and the second frame are connected with each other and rotatable relative to each other, wherein when the first frame and the second frame are rotated relative to each other, the connecting shaft is rotated within the connecting hole.

8. The key structure according to claim 7, wherein when the scissors-type connecting member is fixed between the base plate and the keycap and the keycap is not depressed, the first sidewall and the second sidewall of the scissors-type connecting member are bent, and an overall length of the second segment and the third segment is equal to a distance between the second end of the first sidewall and the first end of the second sidewall, wherein the first segment is a segment from the first end of the first sidewall of the first frame to the middle region of the first sidewall, the second segment is a segment from the second end of the first sidewall of the first frame to the middle region of the first sidewall, the third segment is a segment from the first end of the second sidewall of the second frame to the middle region of the second sidewall, and the fourth segment is a segment from the second end of the second sidewall of the second frame to the middle region of the second sidewall.

9. The key structure according to claim 6, wherein when the scissors-type connecting member is fixed between the base plate and the keycap and the keycap is not depressed, the first sidewall and the second sidewall of the scissors-type connecting member are bent, and an overall length of the second segment and the third segment is equal to a distance between the second end of the first sidewall and the first end of the second sidewall, wherein the first segment is a segment from a first end of the first sidewall to a junction between the first convex part and the second convex part, the second segment is a segment from a second end of the first sidewall to the junction between the first convex part and the second convex part, the third segment is a segment from a first end of the second sidewall to the junction between the first convex part and the second convex part, and the fourth segment is the segment from a second end of the second sidewall to the junction between the first convex part and the second convex part.

10. The key structure according to claim 6, wherein the keycap further comprises a first fixing structure and a second fixing structure, and the base plate further comprises a third fixing structure and a fourth fixing structure, wherein the first fixing structure is disposed on a bottom surface of the keycap, located at a first side of the keycap, and connected with the first end of the first sidewall of the first frame, wherein the second fixing structure is disposed on the bottom surface of the keycap, located at a second side of the keycap, and connected with the second end of the second sidewall of the second frame, wherein the third fixing structure is disposed on the base plate, located at a first side of the base plate, and connected with the first end of the second sidewall of the second frame, wherein the fourth fixing structure is disposed on the base plate, located at a second side of the base plate, and connected with the second end of the first sidewall of the first frame.

* * * * *